US009249514B2

(12) United States Patent
Sivaramakrishnan et al.

(10) Patent No.: US 9,249,514 B2
(45) Date of Patent: Feb. 2, 2016

(54) ARTICLE FORMED BY PLASMA SPRAY

(75) Inventors: Shankar Sivaramakrishnan, Schenectady, NY (US); James Anthony Ruud, Delmar, NY (US); Curtis Alan Johnson, Niskayuna, NY (US); Larry Steven Rosenzweig, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 674 days.

(21) Appl. No.: 13/600,455

(22) Filed: Aug. 31, 2012

(65) Prior Publication Data

US 2015/0140353 A1 May 21, 2015

(51) Int. Cl.
*C23C 28/00* (2006.01)
*C23C 4/10* (2006.01)
(Continued)

(52) U.S. Cl.
CPC ..... *C23C 28/3455* (2013.01); *C23C 4/02* (2013.01); *C23C 4/085* (2013.01); *C23C 4/10* (2013.01); *C23C 4/105* (2013.01); *C23C 4/121* (2013.01); *C23C 4/124* (2013.01); *C23C 4/127* (2013.01); *C23C 28/022* (2013.01); *C23C 28/321* (2013.01); *C23C 28/3215* (2013.01); *C23C 30/00* (2013.01); *C23C 30/005* (2013.01); *F01D 5/288* (2013.01); *Y10T 428/1259* (2015.01); *Y10T 428/1266* (2015.01); *Y10T 428/1275* (2015.01); *Y10T 428/12458* (2015.01);
(Continued)

(58) Field of Classification Search
CPC ..... C23C 4/085; C23C 4/10; C23C 4/105; C23C 4/121; C23C 4/124; C23C 4/127; C23C 28/3215; C23C 28/022; C23C 30/00; C23C 30/005; C23C 28/321; C23C 28/3455; C23C 4/02; Y10T 428/12611; Y10T 428/12618; Y10T 428/12583; Y10T 428/1259; Y10T 428/12604; Y10T 428/1266; Y10T 428/12736; Y10T 428/1275; Y10T 428/12757; Y10T 428/12931; Y10T 428/12937; Y10T 428/12944; Y10T 428/265; Y10T 428/12458
See application file for complete search history.

(56) References Cited

U.S. PATENT DOCUMENTS 5,302,465 A 4/1994 Miller et al.
5,780,110 A 7/1998 Schaeffer et al.
(Continued)

FOREIGN PATENT DOCUMENTS

EP 2336381 A1 6/2011
WO 2006116844 A1 11/2006

OTHER PUBLICATIONS

Hanshin et al., "Isothermal Oxidation of Air Plasma Spray Nicraly Bond Coatings", Surface and Coatings Technology, Feb. 15, 2002, vol. 150, Issues 2-3, pp. 297-308.
(Continued)

*Primary Examiner* — Michael E La Villa
(74) *Attorney, Agent, or Firm* — Paul J. DiConza

(57) ABSTRACT

An article and method of forming the article are disclosed. The article includes a substrate, an overlay bond coat deposited over the substrate and a topcoat deposited over the bond coat. The bond coat of the article includes a plasma affected region proximate to an interface between the bond coat and the topcoat, and the plasma affected region includes an elongated intergranular phase. The method of depositing includes adjusting the plasma spray conditions so as to form the plasma affected region proximate to an interface between the bond coat and the topcoat, and elongated intergranular phases in the plasma affected regions.

17 Claims, 2 Drawing Sheets

Figure 1:
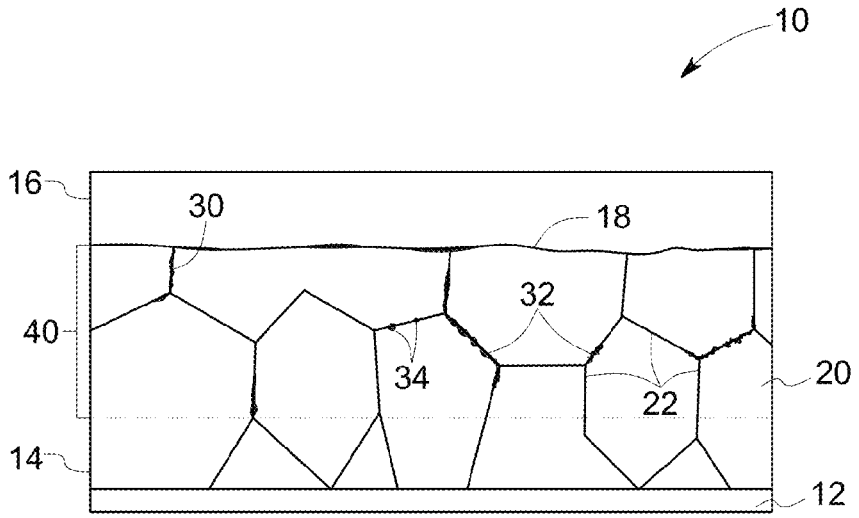

(51) Int. Cl.

| | |
|---|---|
| ***C23C 4/12*** | (2006.01) |
| ***C23C 4/08*** | (2006.01) |
| ***C23C 28/02*** | (2006.01) |
| ***C23C 30/00*** | (2006.01) |
| ***F01D 5/28*** | (2006.01) |
| ***C23C 4/02*** | (2006.01) |

(52) U.S. Cl.

CPC .. *Y10T428/12583* (2015.01); *Y10T 428/12604* (2015.01); *Y10T 428/12611* (2015.01); *Y10T 428/12618* (2015.01); *Y10T 428/12736* (2015.01); *Y10T 428/12757* (2015.01); *Y10T 428/12931* (2015.01); *Y10T 428/12937* (2015.01); *Y10T 428/12944* (2015.01); *Y10T 428/265* (2015.01)

(56) References Cited

U.S. PATENT DOCUMENTS

| | | | | |
|---|---|---|---|---|
| 6,074,706 | A | 6/2000 | Beverley et al. | |
| 6,168,874 | B1 | 1/2001 | Gupta et al. | |
| 6,255,001 | B1 | 7/2001 | Darolia | |
| 6,485,845 | B1 | 11/2002 | Wustman et al. | |
| 6,555,179 | B1 | 4/2003 | Reeves et al. | |
| 6,706,319 | B2 | 3/2004 | Seth et al. | |
| 6,964,791 | B2 | 11/2005 | Zhao et al. | |
| 6,979,498 | B2 | 12/2005 | Darolia et al. | |
| 6,998,151 | B2 | 2/2006 | Grylls et al. | |
| 7,172,820 | B2 | 2/2007 | Darolia et al. | |
| 7,318,955 | B2 | 1/2008 | Darolia et al. | |
| 2003/0008166 | A1* | 1/2003 | Thompson et al. | 428/632 |
| 2005/0019491 | A1* | 1/2005 | Spitsberg et al. | 427/248.1 |
| 2007/0190354 | A1* | 8/2007 | Taylor | 428/678 |
| 2008/0145643 | A1 | 6/2008 | Reynolds et al. | |
| 2009/0280298 | A1 | 11/2009 | Rosenzweig et al. | |

OTHER PUBLICATIONS

Yu et al., "NiAl bond coats made by a directed vapor deposition approach", Materials Science and Engineering A, Elsevier, 2005, pp. 43-52.

PCT Search Report and Written Opinion issued in connection with corresponding Application No. PCT/US2013/052444 on Apr. 10, 2015.

* cited by examiner

ARTICLE FORMED BY PLASMA SPRAY

BACKGROUND

The present invention relates to processes for depositing protective coatings. More particularly, this invention relates to a process for forming an improved bond coat of a thermal barrier coating system.

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to provide turbine, combustor and augmentor components with an environmental coating that inhibits oxidation and hot corrosion, or a thermal barrier coating (TBC) system that thermally insulates the component surface from its operating environment. TBC systems typically include a ceramic layer (TBC) adhered to the component with a metallic bond coat that also inhibits oxidation and hot corrosion of the component surface.

A bond coat is beneficial to the service life of the thermal barrier coating system in which it is employed, and is therefore also beneficial to the service life of the component protected by the coating system. During exposure to the oxidizing conditions within a gas turbine engine, bond coats inherently continue to oxidize over time at elevated temperatures, which gradually deplete aluminum from the bond coat and increases the thickness of the oxide scale. Eventually, the scale reaches a critical thickness that leads to spallation of the ceramic layer at the interface between the bond coat and the oxide scale. Once spallation has occurred, the component will deteriorate rapidly, and therefore must be refurbished or scrapped at considerable cost. In view of the above, there is a continuous need to improve the spallation resistance of such thermal barrier coatings through improvements in the bond coat.

BRIEF DESCRIPTION

Briefly, in one embodiment, an article is disclosed. The article includes a substrate, an overlay bond coat deposited over the substrate and a topcoat deposited over the bond coat. The bond coat of the article includes a plasma affected region proximate to an interface between the bond coat and the topcoat, and the plasma affected region includes an elongated intergranular phase.

In one embodiment, an article is disclosed. The article includes a substrate, an overlay bond coat deposited over the substrate and a topcoat deposited over the bond coat. The substrate of the article includes nickel. The overlay bond coat is formed over the substrate and includes a nickel-aluminum alloy. The topcoat is deposited over the bond coat. The bond coat includes a plasma affected region that has an elongated intergranular phase having a length of at least about 5 microns.

In one embodiment, a method is disclosed. The method includes forming a topcoat over an overlay bond coat through plasma spray deposition using plasma spray conditions that are sufficient to form a plasma-affected region within the bond coat proximate to an interface with the topcoat.

DRAWING

Figure 2:
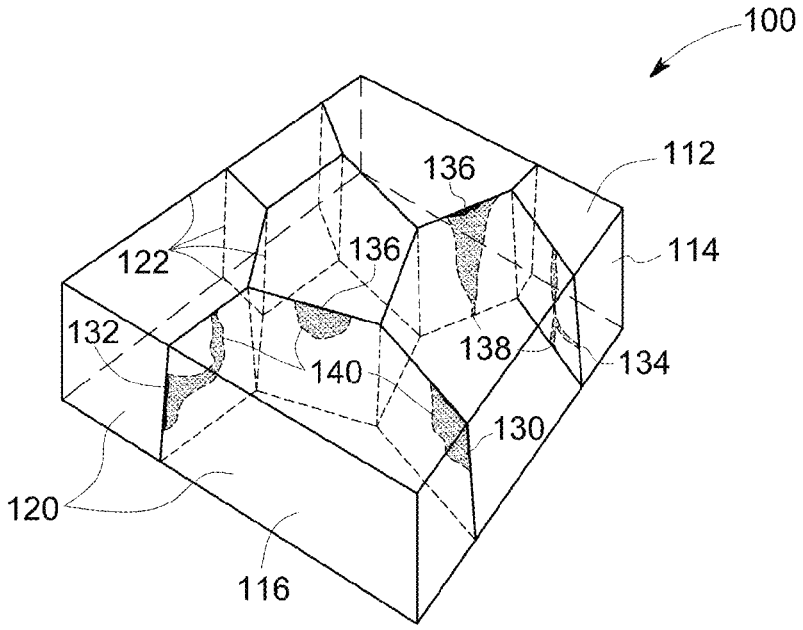
Figure 3:
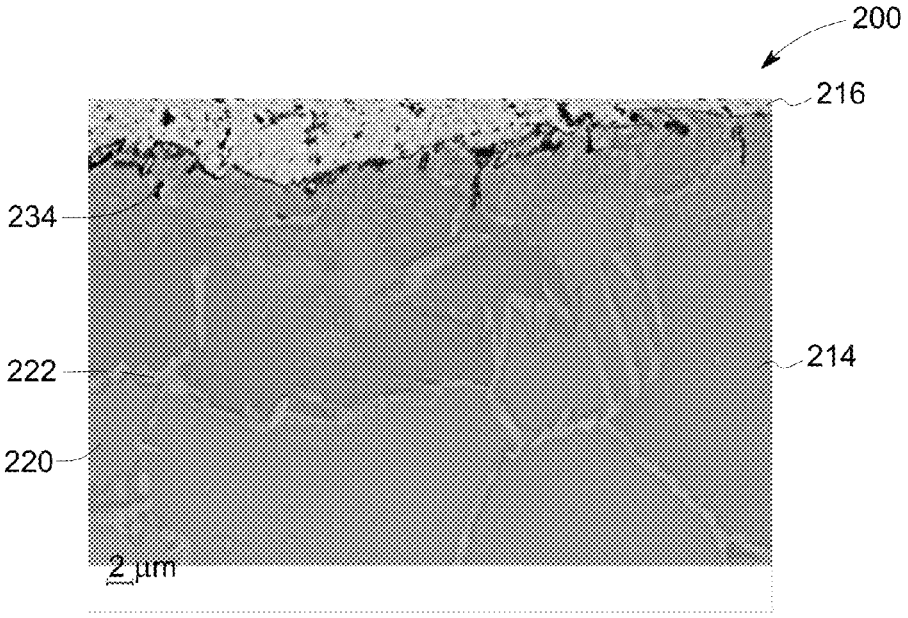
Figure 4:
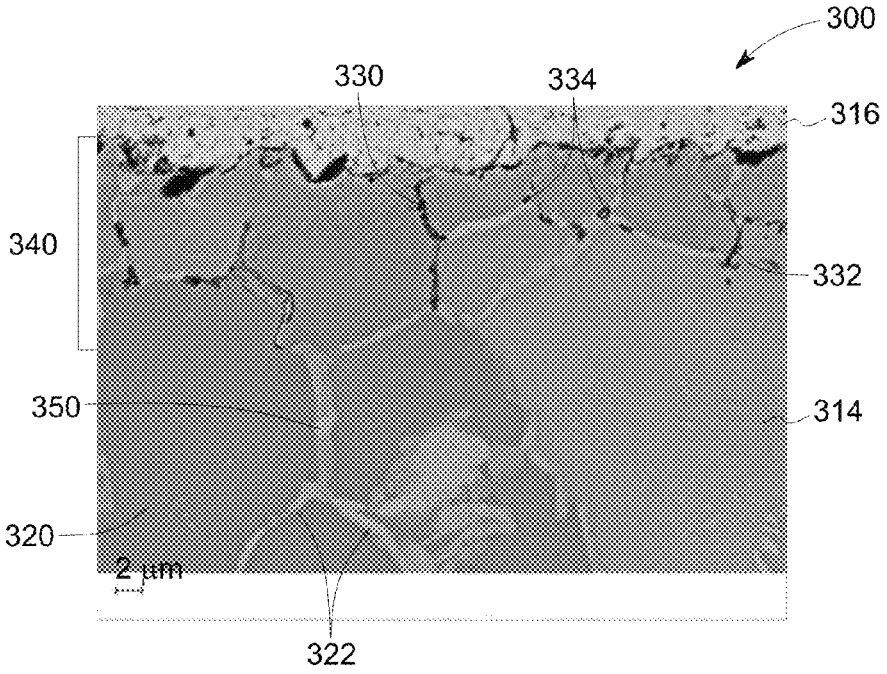

These and other features, aspects, and advantages of the present invention will become better understood when the following detailed description is read with reference to the accompanying drawing, wherein:

FIG. 1 schematically represents a 2D cross-section of an article including an overlay bond coat, according to an embodiment of the invention;

FIG. 2 schematically represents a 3D cross-section of an article including an overlay bond coat, according to an embodiment of the invention;

FIG. 3 illustrates an electron micrograph of a section of an article with a bond coat including less number of elongated intergranular phases, according to an embodiment of the invention; and FIG. 4 illustrates an electron micrograph of a section of an article with a bond coat including a number of elongated intergranular phases, according to an embodiment of the invention.

DETAILED DESCRIPTION

The present invention is generally applicable to components that operate within environments characterized by relatively high temperatures, and are therefore subjected to a hostile oxidizing environment and severe thermal stresses and thermal cycling. Notable examples of such components include the high pressure turbine nozzles and blades, shrouds, combustor liners and augmentor hardware of gas turbine engines. While the advantages of this invention will be described with reference to gas turbine engine hardware, the teachings of the invention are generally applicable to any component on which a thermal bather coating system may be used to protect the component from its environment.

In the following specification and the claims that follow, the singular forms "a", "an" and "the" include plural referents unless the context clearly dictates otherwise.

Briefly, in one embodiment, an article is disclosed. The article includes a substrate, an overlay bond coat deposited over the substrate and a topcoat deposited over the bond coat. The bond coat of the article includes a plasma affected region proximate to an interface between the bond coat and the topcoat, and the plasma affected region includes an elongated intergranular phase.

Coating materials that have found wide use as environmental coatings include diffusion aluminide coatings and overlay coatings. Diffusion aluminide coatings are generally single-layer oxidation-resistant layers formed by a diffusion process, such as pack cementation. Diffusion processes generally entail reacting the surface of a component with an aluminum-containing gas composition to form two distinct zones, the outermost of which is an additive layer containing an environmentally-resistant intermetallic represented by MAl, where M is iron, nickel or cobalt, depending on the substrate material. Beneath the additive layer is a diffusion zone comprising various intermetallic and metastable phases that form during the coating reaction as a result of diffusional gradients and changes in elemental solubility in the local region of the substrate. During high temperature exposure in air, the MAl intermetallic forms a protective aluminum oxide (alumina) scale or layer that inhibits oxidation of the diffusion coating and the underlying substrate.

Coating materials that have found wide use as TBC bond coats and environmental coatings include overlay alloy coatings. The overlay alloy coating materials are those materials that contain various metal alloys such as MCrAlX wherein M is iron, cobalt, nickel, or alloys thereof and wherein X is hafnium, zirconium, yttrium, tantalum, platinum, palladium, rhenium, silicon or a combination thereof. Suitable overlay alloy coating materials can also include MAlX alloys (i.e., without chromium), wherein M and X are defined as before.

Following deposition, the surface of a bond coat is typically prepared for deposition of the ceramic layer by cleaning and abrasive grit blasting to remove surface contaminants, roughen the bond coat surface, and promote the adhesion of the ceramic layer. Thereafter, a protective oxide scale is formed on the bond coat at an elevated temperature to further promote adhesion of the ceramic layer. The oxide scale, often referred to as a thermally grown oxide (TGO), primarily develops from oxidation of the aluminum and/or MAl constituent of the bond coat, and inhibits further oxidation of the bond coat and underlying substrate. The oxide scale also serves to chemically bond the ceramic layer to the bond coat.

Embodiments described herein are useful in protective coatings for metal substrates comprising a variety of metals and metal alloys, including superalloys, used in a wide variety of turbine engine (e.g., gas turbine engine) parts and components operated at, or exposed to, high temperatures, especially higher temperatures that occur during normal engine operation. These turbine engine parts and components can include turbine airfoils such as blades and vanes, turbine shrouds, turbine nozzles, combustor components such as liners, deflectors and their respective dome assemblies, augmentor hardware of gas turbine engines and the like. The embodiments are particularly useful in protective coatings for turbine blades and vanes, and especially the airfoil portions of such blades and vanes. However, while the following discussion of embodiments of the improved bond coatings of this invention will be with reference to turbine blades and vanes, and especially the respective airfoil portion thereof, that comprise these blades and vanes, it should also be understood that the improved bond coatings of this invention can be useful for other articles comprising metal substrates that require protective coatings.

In one embodiment of the present invention, an article is presented. The article includes a substrate, an overlay bond coat and a topcoat. FIG. 1 shows a schematic of 2D cross-section of an article, according to an embodiment of the invention. Referring to FIG. 1, the article 10 includes a base metal 12 that serves as a substrate. Substrate 12 may include any of a variety of metals, or more typically metal alloys. For example, substrate 12 may comprise a high temperature, heat-resistant alloy, e.g., a superalloy. Such high temperature alloys are well disclosed in disclosed in literature. Illustrative high temperature nickel-base alloys are designated by the trade names Inconel®, Nimonic®, Rene® (e.g., Rene® 80, Rene® N5 alloys), and Udimet®.

Protective coatings of this invention are particularly useful with nickel-base superalloys. As used herein, "nickel-base" means that the composition has more nickel present than any other element. The nickel-base superalloys are typically of a composition that is strengthened by the precipitation of the gamma-prime phase. More typically, the nickel-base alloy has a composition of from about 4 to about 20% cobalt, from about 1 to about 10% chromium, from about 5 to about 7% aluminum, from 0 to about 2% molybdenum, from about 3 to about 8% tungsten, from about 4 to about 12% tantalum, from 0 to about 2% titanium, from 0 to about 8% rhenium, from 0 to about 6% ruthenium, from 0 to about 1% niobium, from 0 to about 0.1% carbon, from 0 to about 0.01% boron, from 0 to about 0.1% yttrium, from 0 to about 1.5% hafnium, the balance being nickel and incidental impurities.

As shown in FIG. 1, adjacent to and overlaying substrate 12 is a protective coating indicated generally as bond coat 14. Adjacent to and above the bond coat 14 is the top coat 16. The bond coat layer 14 may be applied, deposited, or otherwise formed on substrate 12 by any of a variety of conventional techniques well known to those skilled in the art in forming bond coats. Non limiting examples of methods of depositing the overlay bond coat 14 on substrate 12 includes by physical vapor deposition (PVD) methods such as electron beam physical vapor deposition (EB-PVD) techniques, and thermal spray techniques, such air plasma spray (APS) and vacuum plasma spray (VPS) techniques.

Various types of plasma-spray techniques well known to those skilled in the art can also be utilized to form TBCs from ceramic compositions. In general, typical plasma spray techniques involve the formation of a high-temperature plasma, which produces a thermal plume. The ceramic coating materials, e.g., ceramic powders, are fed into the plume, and the high-velocity plume is directed towards the bond coat 14 surface.

In one embodiment, the topcoat 16 of the article 10 referred to in FIG. 1 is deposited by an air plasma spray method. The bond coat layer 14 has grains 20 and grain boundaries 22. Generally, bond coat layers 14 formed from overlay bond coating materials are typically substantially uniform in composition, i.e., normally there is no discrete or distinct differences throughout the thickness of the bond coat. In one embodiment of the present invention, the bond coat layer 14 of the article includes some elongated intergranular phases 30, 32, 34 on the grain boundaries 22. As used herein, the "elongated intergranular phases" refer to the phases that are compositionally different than the grains 20; appear in the grain boundaries 22; and are having a one dimensional or two dimensional structure.

The elongated intergranular phases may appear as strings or dots in a two-dimensional cross sectional image such as FIG. 1. In one embodiment, the elongated intergranular phases are present in the bond coat layer 14 nearer to an intersection 18 of the bond coat 14 and top coat 16.

Without being bound by any particular theory, it is possible that the elongated intergranular phases found in the bond coat region 14 of the article might have formed due to the action of rapid heating and cooling of the bond coat material during the plasma deposition of the topcoat 16. The applied plasma may affect the interface 18, and the adjacent region of the bond coat 14 near the interface. The plasma may induce microcracks in the grain boundaries 22 of bond coat material, and may cause formation of intergranular phases in an affected bond coat region 40. Therefore, the region of the bond coat 14 that is affected by the applied plasma is herein termed as the "plasma affected region" 40. The plasma affected region may be formed in the bond coat 14 as an upper portion 40 that is directly adjacent to topcoat 16 and in contact with the interface 18. The plasma affected region 40 may or may not have different characteristics than the rest of the bond coat region 14. In one embodiment, the elongated intergranular phases 30, 32, 34 appear in the plasma affected region. Therefore, in one embodiment, the "plasma affected region" may be defined as the region wherein the elongated intergranular phases are observed in the bond coat region 14.

In one embodiment, the elongated intergranular phases 30, 32, 34 have a composition including zirconium, aluminum, oxygen, or any combinations of the foregoing. In one embodiment, the elongated intergranular phases 30, 32, 34 include oxides of zirconium and aluminum. In one embodiment, the elongated intergranular phases 30, 32, 34 consist essentially of zirconium aluminum oxides. In a two dimensional cross sectional observation (such as FIG. 1), the elongated intergranular phases may appear to be strings connected to the interface 18 (30), strings disconnected from the interface 18 (32), or dots 34 in the plasma affected region 40 of the bond coat region 14. However, not to be bound by any theory, it is envisaged that an oxide phase of the elongated intergranular phases 30, 32, 34 may be formed in the plasma affected region 40, if the locations of the elongated intergranular phases 30, 32, 34 have an access to the surface (interface 18) oxygen. Therefore, the oxide based elongated intergranular phases 30, 32, 34 might have had access to the surface at least at the time of forming In one embodiment, the elongated intergranular phases 30, 32, 34 are connected to the interface 18. This can be observed more clearly in a three dimensional schematic of a part of the bond coat region 14 as shown in FIG. 2. The cube 100 of FIG. 2 shows a three dimensional cross-section of a part of the bond coat region 14, that is exposed to the interface 18 (in FIG. 1). The cube 100 includes the top surface 112 that may be the interface 18 with the topcoat 16 (of FIG. 1). The surfaces 114 and 116 are the front surfaces that are observable in the schematic. The three dimensional grains 120 meet each other at the grain boundaries 122. The elongated intergranular phases 130, 132, and 134 are shown as the two dimensional intergranular phases.

Comparing FIG. 1 and FIG. 2, the elongated intergranular phase 30 may be equated with the elongated intergranular phase 130 of FIG. 2. Both the phases are seen as connected to the interface 18 (FIG. 1) or the top surface 112 (FIG. 2). Similarly the elongated intergranular phases 32 that are seemingly unconnected with the interface 18 in FIG. 1 may be similar to the intergranular phase 132 of the FIG. 2. The intergranular phase 132 seems to be not connected to the top surface 112 if observed from the front surface 116. However, the 3D schematic of the cube 100 shows the connection of this phase 132 to the top surface through the grain boundaries 122 inside the cube 100. Similarly the seemingly dots 34 in FIGS. 1 and 134 in FIG. 2 may be connected to the top surface 18 or 112, respectively as can be seen from FIG. 2. In line with the elongated intergranular phases 130, 132, and 134, there may be some other elongated intergranular phases 136 that are inside the cube 100, and connected to the surface 112, but are not observed in any of the two dimensional cross sections in the front phases 114 or 116.

Thus in one embodiment, at least some of the elongated intergranular phases are considered to be two dimensional platelets that may be present in the plasma affected region 40. In one embodiment, the elongated intergranular phases 30, 32, 34 (or 130, 132, 134) have length, width and thickness. As used herein, the "length" of the elongated intergranular phases is the longest dimension in any direction, "width" is the second longest direction, which is perpendicular to the length. The "thickness" of the elongated intergranular phases are defined as the extent of the elongated intergranular phases in a direction that is perpendicular to the length and width of the phase at any given grain boundary. In one embodiment, the thickness of the elongated intergranular phases is always less than the grain boundary thickness of the adjacent grains. As used herein, the grain boundary thickness in between a pair of grains is defined as the shortest distance between those two grains at any given place.

In one embodiment, the length of the elongated intergranular phase is at least about 3 microns. In one embodiment, the length at least about 5 microns, and in a further embodiment, the length is in a range from about 8 microns to about 15 microns. In one embodiment, a length to thickness ratio of the elongated intergranular phase is greater than about 5. In a further embodiment, the length to thickness ratio is greater than about 8.

In one embodiment, the length of the elongated intergranular phases is substantially in a direction that is perpendicular to the interface 18 (FIG. 1) of the bond coat 14 and top coat 16. In this embodiment, the length of the elongated intergranular phase is measured from the interface to deep into the plasma affected region 40. In one embodiment, the plasma affected region 40 is defined as that depth of the bond coat region 14 from the interface 18, up to where the elongated intergranular phases are present. Thus, in one embodiment, the extent of depth of the plasma affected region 40 from interface 18 is identified by the presence of deepest of the elongated intergranular phase in the thickness of the bond coat 14 at a cross section perpendicular to the interface 18. In one embodiment, the plasma affected region extends from the interface to at least about 5 microns into the thickness of the bond coat 14. In one embodiment, the plasma affected region extends to at least 10 microns from the interface 18.

In one embodiment, the number of elongated intergranular phases observed within the plasma affected region 40 close to the interface 18 is higher in relative to the number of elongated intergranular phases in the plasma affected region 40 that is deep inside from the interface 18. Thus in one embodiment, the plasma affected region 40 has a concentration gradient of the elongated intergranular phases as a function of distance in a direction from the interface 18 towards the substrate 12. As used herein the "concentration" is defined as the number of elongated intergranular phases per unit length that intersects a line drawn parallel to the interface at the cross section. The concentration gradient of the elongated intergranular phases 30, 32, 34 may arise because of the reduced effect of plasma that may be seen deep within the plasma affected region 40, or may be because of the reduced availability of oxygen in the deeper parts of plasma affected region 40.

Without being bound by any particular theory, it is believed that the existence of elongated intergranular phases 30, 32, 34 increases the bond strength of the top coat 16 with the bond coat 14 and reduces the spallation of top coat 16 during operation of the article. Further, in one embodiment, the presence of elongated intergranular phases in the bond coat 14 increase the tolerability of high densities of top coats 16 deposited over the bond coat 14. That is, life times of the dense top coats 16 deposited on the bond coats 14 having elongated intergranular phases 30, 32, 34 are greater than the life times of the top coats that are deposited on the bond coats that does not have elongated intergranular phases. In one embodiment, the density of the topcoat 16 that is deposited over the bond coat 14 for a use in a high temperature environment is greater than about 80% of theoretical density of the top coat material. In one embodiment, a method of depositing an article is presented. The embodiments of the method of this invention are useful in applying or repairing thermal bather coatings for a wide variety of turbine engine (e.g., gas turbine engine) parts and components that are formed from metal substrates comprising a variety of metals and metal alloys, including superalloys, and are operated at, or exposed to, high temperatures, especially higher temperatures that occur during normal engine operation. These turbine engine parts and components can include turbine airfoils such as blades and vanes, turbine shrouds, turbine nozzles, combustor components such as liners, deflectors and their respective dome assemblies, augmentor hardware of gas turbine engines and the like.

In one embodiment, the method involves forming a topcoat over an overlay bond coat through plasma spray deposition using plasma spray conditions sufficient to form a plasma-affected region within the bond coat proximate to an interface with the topcoat. As used herein the "plasma spray conditions sufficient to form a plasma-affected region" include any structural and operating parameters that affect the plasma power operated on the bond coat 14 surface during the deposition of top coat 16.

Various details of such plasma spray coating techniques will be well-known to those skilled in the art, including various relevant steps and process parameters such as cleaning of the surface 18 of bond coat layer 14 prior to deposition; grit blasting to remove oxides and roughen the surface substrate temperatures, plasma spray parameters such as spray distances (gun-to-substrate), selection of the number of spray-passes, powder feed rates, particle velocity, torch power, plasma gas selection, oxidation control to adjust oxide stoichiometry, angle-of-deposition, post-treatment of the applied coating; and the like. Generally torch power may vary in the range from about 10 kilowatts to about 200 kilowatts. The velocity of the ceramic coating composition particles flowing into the plasma plume (or plasma "jet") is another parameter which is usually controlled very closely.

A typical plasma spray system includes a plasma gun anode which has a nozzle pointed in the direction of the deposit-surface of bond coat layer. The plasma gun is often controlled automatically, e.g., by a robotic mechanism, which is capable of moving the gun in various patterns across the surface of bond coat layer. The plasma plume extends in an axial direction between the exit of the plasma gun anode and the surface of bond coat layer. Some sort of powder injection means is disposed at a predetermined, desired axial location between the anode and the surface of bond coat layer. In some embodiments of such systems, the powder injection means is spaced apart in a radial sense from the plasma plume region, and an injector tube for the powder material is situated in a position so that it can direct the powder into the plasma plume at a desired angle. The powder particles, entrained in a carrier gas, are propelled through the injector and into the plasma plume. The particles are then heated in the plasma and propelled toward the bond coat layer. The particles melt, impact on the bond coat layer, and quickly cool to form TBC.

In one embodiment of the present invention, the plasma power used for the deposition of the top coat 14 is greater than about 95 kW. In one embodiment, the power is greater than 100 KW. In one embodiment, the flow rate of plasma gases is greater than about 300 standard liters per minute (slpm) and the distance from the spray gun to the substrate is lesser than about 120 mm.

EXAMPLE

The following examples illustrate comparative methods, materials, and results, in accordance with specific embodiments, and as such should not be construed as imposing limitations upon the claims.

Deposition of top coat over the bond coat were carried out using varying plasma spray conditions out of which two representative methods were detailed below. The structural and property characteristics were measured and compared.

In an Example 1, an ion plasma deposited nickel aluminide was used as bond coat on a nickel base alloy substrate. About 50 microns thick porous 7-8 Wt % yttria stabilized zirconia (YSZ) TBC was deposited using a slurry having an average particle size of $d_{50}$=0.4 microns. The plasma conditions used were as follows: 85 kW power, 245 slpm of gases and a gun to substrate distance of about 75 mm The density of the 50 micron thick porous TBC coating was approximately 89%. Over this porous TBC, about 100 micron thick dense TBC coating was deposited using the same slurry, but with the varied operational plasma conditions of about 105 kW power, about 350 slpm gases, and a gun to substrate distance of about 100 mm The density of the 100 micron thick dense TBC coating was approximately 95%.

In an Example 2, the substrate and bond coat material remained same as the Example 1. About 160 micron thick dense TBC coating was deposited using a slurry including a bimodal particle size distribution. The average bimodal particle sizes in the slurry were about 0.7 microns and about 1.1 microns. The operational plasma conditions were about 105 kW power, about 350 slpm gases, and a gun to substrate distance of about 100 mm The density of the 160 micron thick dense TBC coating was approximately 95%.

FIG. 3 presents an electron micrograph of the cross section 200 of the bond coat 214—top coat 216 intersection regions of Example 1 showing the grains 220, grain boundaries 222, and the elongated intergranular phases 234. FIG. 4 is an electron micrograph of the cross section 300 of the bond coat 314—top coat 316 interface regions of Example 2 showing the grains 320, grain boundaries 322, and the elongated intergranular phases 330, 332, and 334 in a plasma affected region 340. Clearly, more elongated intergranular phases were observed to be present in the FIG. 4 corresponding to the direct, dense coating over the bond coat of Example 2, as compared to that of Example 1.

A porous TBC before applying the dense TBC of Example 1 was used to typically decrease the spallation of TBCs as it was known that typically the direct deposition of dense top coat over the bond coat increases the spallation of TBCs. Surprisingly, when the furnace cycle test (FCT) life tests of these two coatings were conducted at similar conditions to find out the life times, it was found that the direct dense coatings of Example 2 showed two times life time compared to that of Example 1. The increased FCT life of the TBCs of Example 2 compared to that of Example 1 is attributed to a stronger adhesion of top coat 316 to bond coat 314 as compared to the top coat 216 adhesion to the bond coat 214 adhesion of Example 1. The stronger adhesion of Example 2 is believed to arise from the sufficient number of elongated intergranular phases that are observed in the bond coat (near the bond coat/TBC interface). The elongated intergranular phases 330, 332, and 334 were subjected to elemental analysis and were found to be rich in zirconium, aluminum and oxygen.

In one embodiment, it is believed that the number and lengths of the elongated intergranular phases play a significant role in determining the adhesion of the top coats to the bond coats. Therefore, it is postulated that if an article microstructure has a number of short (<3 microns) elongated intergranular phases as compared to another showing a similar number of long (>3 microns) elongated intergranular phases, then the article that has the longer elongated intergranular phases has a better chance of having improved adhesion as compared to the article that has comparatively shorter elongated intergranular phases.

In some embodiments, along with the elongated intergranular phases some other intergranular phases 350 were observed as in FIG. 4. These may be substantially insoluble compounds that are distinct in appearance and composition from the elongated intergranular phases that are characterized as above. The intergranular phases 350 may include alloy precipitates, metal oxides, metal nitrides, metal carbides, and mixtures thereof. However, while conducting the comparative studies of the Example 1 and Example 2, no other intergranular species were purposefully added to any of the example articles.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An article comprising:

a substrate;

an overlay bond coat deposited over the substrate; and a plasma sprayed ceramic topcoat deposited over the bond coat, wherein the bond coat comprises:

a MAlX alloy or a MCrAlX alloy, wherein M comprises iron, cobalt, nickel, or alloys thereof, and X comprises hafnium, zirconium, yttrium, tantalum, platinum, palladium, rhenium, silicon or combinations thereof, and a plasma affected region proximate to an interface between the bond coat and the topcoat, the plasma affected region comprising an elongated intergranular phase having a length to thickness ratio greater than 5.

2. The article of claim 1, wherein the plasma affected region extends from the interface to at least about 5 microns thickness of the bond coat at a cross section perpendicular to the interface.

3. The article of claim 2, wherein the plasma affected region comprises a concentration gradient of the elongated intergranular phase, the gradient running from a higher concentration near the interface to a lower value as a function of distance in a direction towards the substrate.

4. The article of claim 1, wherein the substrate comprises nickel-based superalloy.

5. The article of claim 1, wherein the M comprises nickel.

6. The article of claim 5, wherein the X comprises zirconium.

7. The article of claim 1, wherein the elongated intergranular phase comprises zirconium, aluminum, oxygen, or any combinations of the foregoing.

8. The article of claim 1, wherein a length of the elongated intergranular phase is at least about 5 microns.

9. The article of claim 1, wherein the length to thickness ratio of the elongated intergranular phase is greater than about 8.

10. The article of claim 1, wherein a density of the topcoat is greater than about 80% of a theoretical density of the topcoat.

11. An article comprising:

a substrate;

an overlay bond coat formed over the substrate; and a plasma sprayed ceramic topcoat deposited over the bond coat, wherein the bond coat comprises:

a plasma affected region comprising an elongated intergranular phase having a length of at least about 5 microns, and a MAlX alloy or a MCrAlX alloy, wherein M comprises iron, cobalt, nickel, or alloys thereof, and X comprises hafnium, zirconium, yttrium, tantalum, platinum, palladium, rhenium, silicon or combinations thereof.

12. The article of claim 11, wherein the elongated intergranular phase comprises zirconium, aluminum, and oxygen.

13. A method, comprising:

depositing an overlay bond coat over a substrate, the overlay bond coat comprising a MAlX alloy or a MCrAlX alloy, wherein M comprises iron, cobalt, nickel, or alloys thereof, and X comprises hafnium, zirconium, yttrium, tantalum, platinum, palladium, rhenium, silicon or combinations thereof; and forming a ceramic topcoat over the overlay bondcoat through plasma spray deposition using plasma spray conditions sufficient to form a plasma-affected region within the bond coat proximate to an interface with the topcoat, wherein the plasma-affected region comprises an elongated intergranular phase having a length to thickness ratio greater than 5.

14. The method of claim 13, wherein a plasma power used for the deposition is greater than about 95 kW.

15. The method of claim 13, wherein a flow rate of plasma gases is greater than about 300 slpm.

16. The method of claim 13, wherein forming the ceramic topcoat comprises operating a plasma spray gun, wherein a distance from the spray gun to the substrate is less than about 120 mm.

17. The method of claim 13, wherein the M comprises nickel.

* * * * *